US009354018B2

(12) United States Patent
Khoshnood

(10) Patent No.: US 9,354,018 B2
(45) Date of Patent: May 31, 2016

(54) CROSSBOW WITH A RELEASE MECHANISM

(71) Applicant: MCP IP, LLC, Sparta, WI (US)

(72) Inventor: Bahram Khoshnood, Cumming, GA (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 14/208,291

(22) Filed: Mar. 13, 2014

(65) Prior Publication Data

US 2015/0260477 A1 Sep. 17, 2015

(51) Int. Cl.
*F41B 5/12* (2006.01)
*F41A 19/06* (2006.01)

(52) U.S. Cl.
CPC .. *F41B 5/12* (2013.01); *F41A 19/06* (2013.01)

(58) Field of Classification Search
CPC ..... F41B 5/12
USPC ..... 124/25
See application file for complete search history.

(56) References Cited

U.S. PATENT DOCUMENTS 5,243,956 A * 9/1993 Luehring ..... 124/86
8,522,761 B1 * 9/2013 Chu ..... 124/25
2014/0246003 A1 * 9/2014 Lipowski ..... 124/25

* cited by examiner

*Primary Examiner* — Gene Kim
*Assistant Examiner* — Jeffrey Vanderveen

(57) ABSTRACT

A trigger mechanism for use in a crossbow comprises a housing having a first slot formed in a first side and a second slot formed in a second side opposite the first side. A trigger lever, a bowstring catch and a disarm mechanism are all moveably mounted in the housing. The catch has a first end configured to engage the trigger lever and a second end configured to retain the bowstring in a cocked position. The disarm mechanism is partially positioned in the second slot and is moveable between a fixed first position proximate the housing second slot toward a second disarm position toward the housing first slot. As the disarm mechanism moves from the first position into the second position, it engages the trigger lever causing it to move out of engagement with the catch first end allowing the user to release the bowstring using the bowstring cocking device from the trigger mechanism without having to engage the trigger.

20 Claims, 5 Drawing Sheets

CROSSBOW WITH A RELEASE MECHANISM

BACKGROUND

The present invention relates generally to crossbows and in particular to a release mechanism for un-cocking a crossbow.

Crossbows have been used since the middle ages. Crossbows have evolved to include cams and synthetic split limbs that greatly increase firing velocity. However, increased firing velocity creates a problem when a crossbow is dry-fired in order to release the bowstring from a cocked position into an un-cocked position without firing a bolt or arrow. Unloaded or dry firing impacts can damage the bowstring, limbs, cams and other components. Dry firing also creates a safety concern. The invention addresses the problems at hand by allowing the crossbow users to uncock the bowstring without dry firing or engaging the trigger with user's hand.

SUMMARY OF THE INVENTION

In one embodiment, the invention is directed to a trigger mechanism for use in a crossbow having a bowstring. The trigger mechanism comprises a housing that encloses the various parts of the trigger mechanism. In various embodiments, the housing may encompass a first slot formed thorough a first side of the housing and a second slot formed through a second side of the housing opposite the first side. The first slot may be configured to receive the bowstring of the cross bow when the crossbow is cocked, and the second slot may be configured to receive a portion of a bowstring cocking device when a user is cocking or releasing the bowstring. In various embodiments, the housing may encompass (1) a trigger lever, (2) a catch and (3) a disarm mechanism. In various embodiments, the housing may further comprise a trigger lever rotatably mounted in the housing. In some embodiments, the trigger lever may comprise a trigger that extends (partially or completely) outside the housing. In some embodiments, the trigger mechanism may comprise a catch rotatably mounted in the housing. The catch may have a first end configured to engage with the trigger lever and a second end configured to retain a bowstring in a cocked position. In various embodiments, the catch is moveable between a first cocked positions and a second release position.

In various embodiments, a disarm mechanism may have a first portion in operative engagement with the trigger lever, a second portion in operative engagement with a release switch and a third portion that may be at least partially positioned in the second slot. In some embodiments, the third portion of the disarm mechanism is configured to be engaged by a bowstring cocking device. In some embodiments, when the release switch is in a first position the disarm mechanism is retained in a first fixed position. In these and other embodiments, when the release switch is in a second position the user may use the bowstring cocking device to release the bowstring from the cocked position into an un-cocked resting position. The disarm mechanism is configured to move from a first position into a second position in which the disarm mechanism causes the trigger lever to move out of engagement with the catch first end, which allows the catch to move from the catch first position into the catch second position.

In various embodiments, the disarm mechanism is slidably mounted in the housing and has a first portion that is configured to operatively engage the trigger lever. In some of these embodiments, the trigger lever has a trigger first portion configured to operatively engage the catch first end and a trigger lever second portion configured to operatively engage the disarm mechanism first portion. In various embodiments, the trigger mechanism further comprises a safety mechanism that is moveable between (1) a safety on first position in which the safety mechanism impedes movement (e.g., rotation) of the trigger lever; and (2) a firing second position in which the safety mechanism allows the trigger lever to move out of engagement with the catch first end when the trigger is engaged by the user.

In various embodiments, when the release switch is in the second position, the disarm mechanism can move (e.g., slide, rotate, etc.) toward the housing first slot out of the fixed first position and into the second position thereby biasing the trigger lever out of engagement with the catch first end, which allows the catch to move from the catch first position into the catch second position. In various embodiments, a bowstring cocking device can be used to move the disarm mechanism from the first position into the second position. In some of these embodiments, the trigger lever comprises a trigger lever first portion that is pivotally coupled to the trigger lever and that is biased into a first portion first position by a spring.

In various embodiments, the trigger mechanism further comprises a crossbow having: (1) an elongated body; (2) a first limb coupled to a first end of the elongated body; (3) a second limb coupled to the elongated body first end; and (4) a bowstring having a bowstring first end operatively coupled to the first limb and a bowstring second end operatively coupled to the second limb, and the trigger mechanism is coupled to the elongated body so that the housing first slot aligns with a path on which the bowstring travels when moved into the cocked position. In some embodiments, the bowstring cocking device comprises: (1) an elongated rope having a first end and a second end; (2) a first handle coupled to the rope first end and a second handle coupled to the rope second end; (3) a first hook and a second hook, wherein the first and second hooks are positioned on the rope intermediate the first and second handles.

BRIEF DESCRIPTION OF THE DRAWINGS

Having described various embodiments in general terms, reference will now be made to the accompanying drawings, which are not necessarily drawn to scale, and wherein.

DETAILED DESCRIPTION OF VARIOUS EMBODIMENTS

Figure 1:
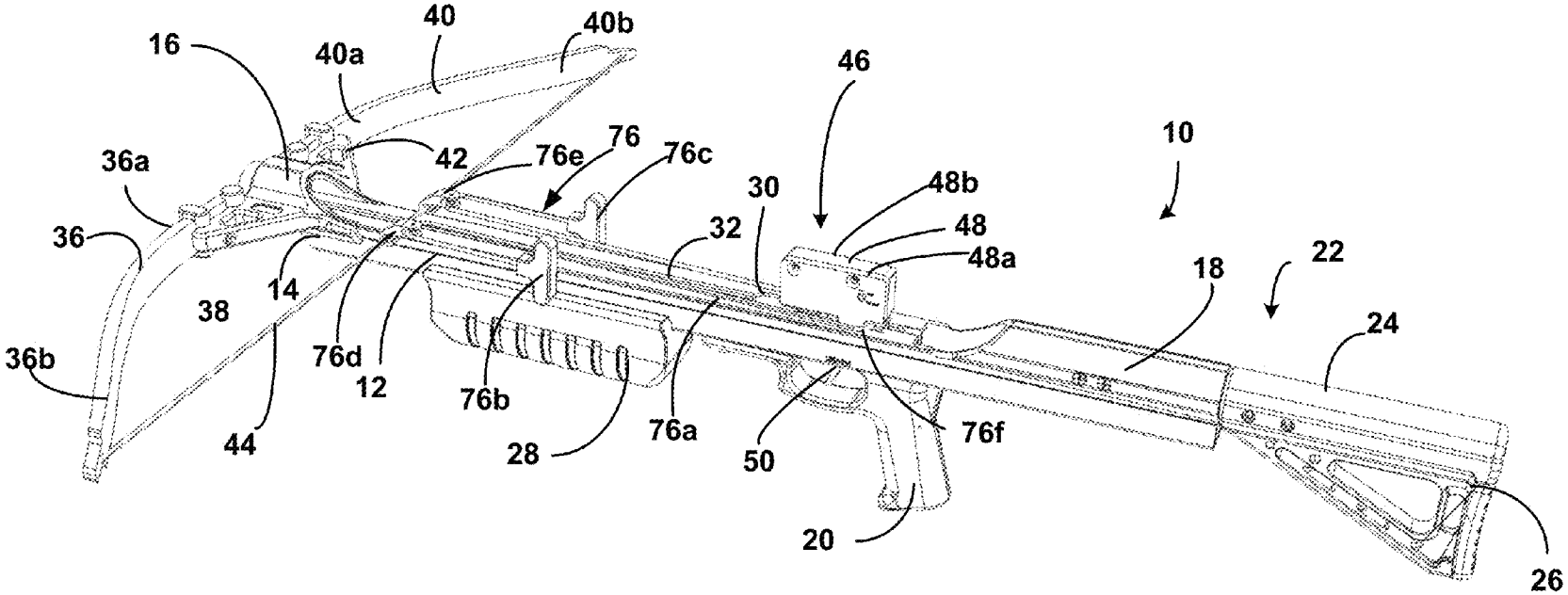
FIG. 1 is a perspective view of a crossbow having an embodiment of a trigger mechanism used therein.

Various embodiments will now be described more fully herein with reference to the accompanying drawings, in which various relevant embodiments are shown. The invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Overview

A crossbow contains a trigger mechanism having a two-piece housing, a trigger lever, a bowstring catch, a safety switch and a disarm mechanism. The housing has a first slot formed in a first side of the housing and a second slot formed in a second side of the housing opposite the first side. The first slot is configured to receive a bowstring of a crossbow when the bow string is pulled into the cocked position and the second slot is configured to receive a portion of a bowstring cocking device when the bowstring cocking device is used to either cock the crossbow or release the bowstring from a cocked position without firing or dry firing the crossbow.

The trigger lever is moveably (e.g., slidable, rotatable, etc.) mounted in the housing and has a trigger coupled to the trigger lever that extends at least partially from the bottom of the housing. In various embodiments, the trigger may be integrally formed with the trigger lever, or in other embodiments, the trigger may be connected to the trigger lever using any suitable fastener (e.g., a bolt, a pin, a rivet, weldments, etc.).

The disarm mechanism is moveably (e.g., slidable, rotatable, etc.) mounted in the housing and is moveable between a fixed first position and a disarm second position. In various embodiments, when the disarm mechanism moves from the first position into the second position, the disarm mechanism moves toward the housing first slot. A disarm switch is moveably (e.g., slidable, rotatable, etc.) mounted in the housing and is moveable between a first position in which the disarm mechanism is maintained in the fixed first position and a disarm second position. Thus, when the disarm switch is in the first position, the disarm mechanism is maintained in the fixed first position, and when the disarm switch is in the second position, the disarm mechanism is moveable from the first position into a second position in which the disarm mechanism causes the trigger lever to move out of engagement with the bowstring catch. As a result, the bowstring catch may rotate from a cocked first position into a firing section position. In various embodiments, the disarm mechanism may be moved from the first position into the second position when a user uses the bowstring cocking device to release the bowstring from the cocked position. That is, when the user pulls on the bowstring cocking device handles (which puts tension on the bowstring), the bowstring cocking device causes the disarm mechanism to slide forward toward the housing first slot. As the disarm mechanism slides, it engages the trigger lever causing the trigger lever to move out of engagement with the catch. As a result, the bowstring catch may rotate from a cocked position into a release position where the user can slowly release the bowstring using the bowstring cocking device.

Cross Bow Structure

Referring to FIG. 1, a crossbow 10 is shown having a barrel 12, which has a first end 14 coupled to a riser 16 and a second end 18 coupled to a pistol grip 20, and a stock 22. The stock 22 has a comb 24 and a butt 26. In the embodiment shown, the stock length is adjustable, but in other embodiments the stock may have a fixed length. A grip 28 is coupled to the barrel 12 intermediate the first and second ends 14 and 18. A retention spring 30 is operatively coupled to a top surface 32 of the barrel 12. A first limb 36 has a first side 36*a* operatively coupled to a left side 38 of the riser 16 and a second side 36*b* operatively coupled to a bowstring 44. A second limb 40 has a first end 40*a* that is operatively coupled to a right side 42 of the riser 16 and a second end 40*b* that is operatively coupled to the bowstring 44. A trigger mechanism 46 having a housing 48 is partially received in the barrel 12 adjacent the pistol grip 20.

A bowstring cocking device 76 is releasably coupled to the bowstring 44 and contains an elongated cocking rope 76*a* having a first handle 76*b* at a first rope end and a second rope handle 76*c* at a second rope end. The cocking rope has a center portion 76*f* that loops behind the trigger mechanism 46. Additionally, the bowstring cocking device has a first hook 76*d* and a second hook 76*e* intermediate the rope handles 76*b* and 76*c* and the center portion 76*f* of the cocking rope 76. The first and second hooks 76*d* and 76*e* are configured to attach to the bow string so that when a user pulls on the handles 76*b* and 76*c*, the cocking rope pulls the bowstring 44 back toward the trigger mechanism 46.

Trigger Mechanism

Figure 2:
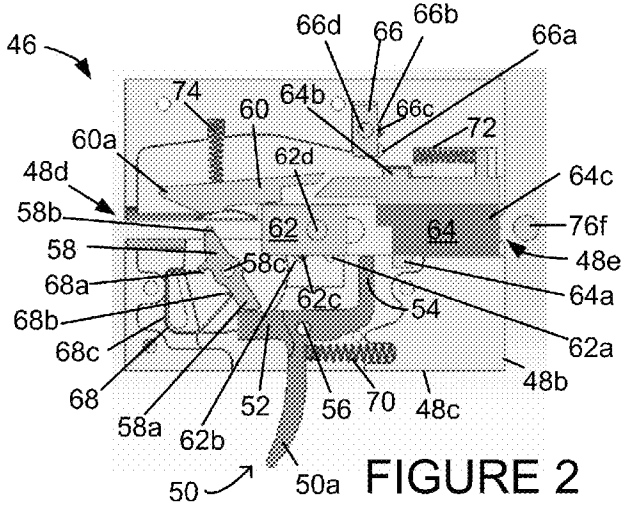
FIG. 2 is a partial sectional view of an embodiment of the trigger mechanism used in the crossbow of FIG. 1 with the release switch in the second position.

Referring to FIG. 2, the trigger mechanism 46 contains a two piece housing 48 (FIG. 1) having a first housing portion 48*a* (FIG. 1) and a second housing portion 48*b* (FIGS. 1 and 2) that together enclose the various parts of the trigger mechanism. Additionally, the housing 48 has a first slot 48*d* configured to receive the bowstring 44 of the crossbow 10 (FIG. 1) and a second slot 48*e* configured to receive the center portion 76*f* of the bowstring cocking device 76. In various embodiments, an opening may be used in place of the slot depending on the design of the disarm mechanism.

In general, the trigger mechanism 46 comprises a trigger lever 50 having a trigger 50*a* that extends (completely, partially or not at all) from the bottom of the housing 48*c*, a bowstring catch 58, a safety switch 62 that is slidable between a safety on first position (FIG. 5) and a firing second position (FIGS. 2-4), a disarm mechanism 64, and a release switch 66 that is slidable between a first position (FIGS. 3-5) and a disarm second position (FIG. 2).

Still referring to FIG. 2, the trigger lever 50 is pivotally mounted in the housing 48 by a pin 56. The trigger lever 50 has the trigger 50*a* that extends (completely or partially) out from the housing 48. The trigger lever 50 also has a trigger lever first portion 52 and a trigger lever second portion 54. The trigger lever first portion 52 is pivotally mounted to the trigger lever 50 and is biased into a first portion first position by a spring (not shown). In various embodiments, the trigger 50*a* may be integrally formed with the trigger lever 50, or in other embodiments, the trigger may be connected to the trigger lever using any suitable fastener (e.g., a bolt, a pin, a rivet, weldments, etc.

Figure 12:
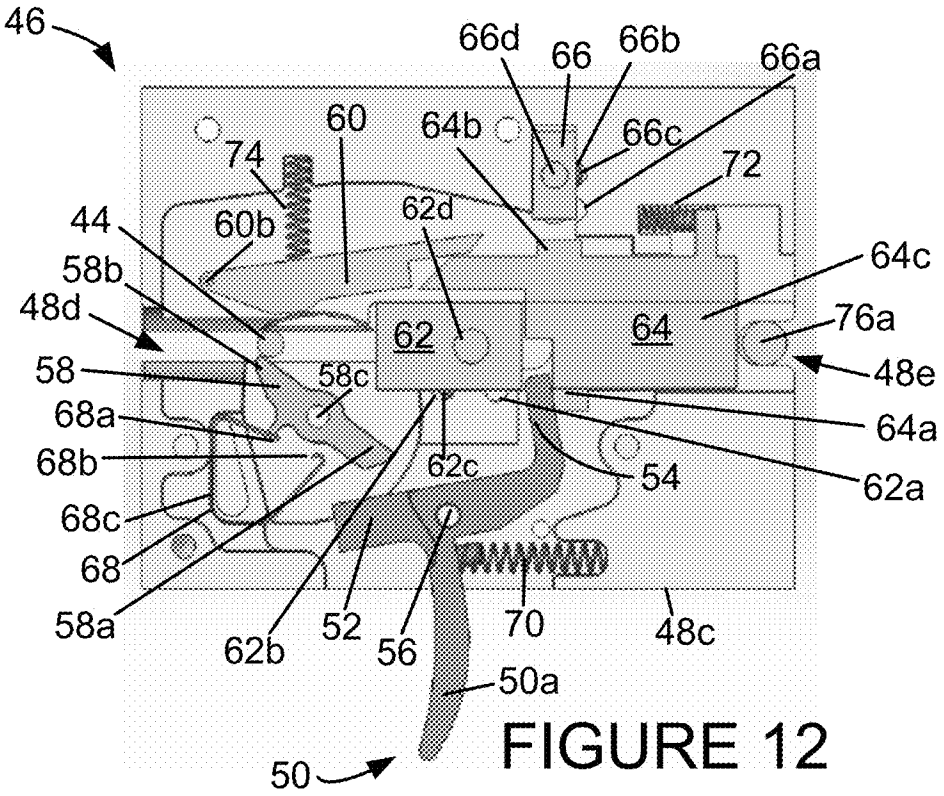
FIG. 12 is a partial sectional view of the trigger mechanism of FIG. 11, with the bow string being moved into an uncocked resting position.

The catch 58 is pivotally mounted in the housing 48 by a pin 58*c* and is biased by a flat spring 68. The catch 58 is configured to rotate from a cocked first position (FIG. 5) to a firing second position (FIG. 12) or vice versa. The catch 58 has a catch first end 58*a* that is configured to operatively engage with the trigger lever first portion 52. The catch 58 also has a catch second end 58*b* that is configured to retain the bowstring 44 in a cocked position when the catch 58 is in the catch first position (FIGS. 7-10). The flat spring 68 has a first end 68*a*, a second end 68*b* and a body 68*c* positioned between the first end 68*a* and the second end 68*b*. The flat spring first end 68*a* is configured to engage and bias the catch second end 58*b* when the catch 58 rotates counterclockwise from the catch first position to the catch second position (FIG. 12). The flat spring second end 68*b* is configured to engage and bias the catch first end 58*a* when the catch 58 rotates clockwise from the catch second position into the catch first position.

Figures 8, 9, 10, 11:
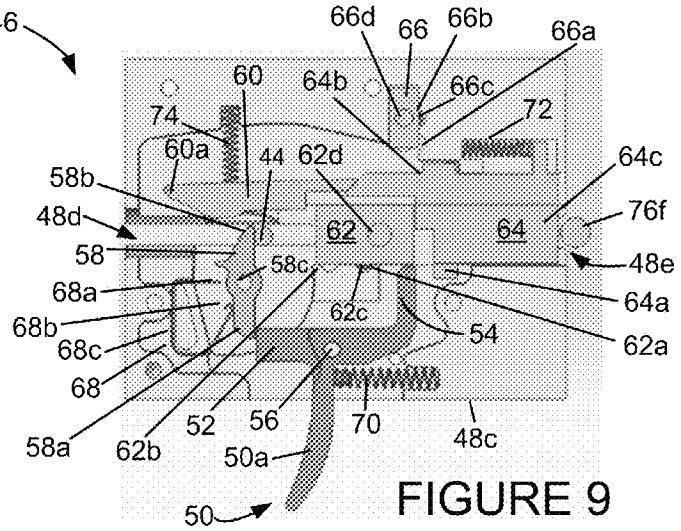
FIG. 8 is a partial sectional view of the trigger mechanism of FIG. 2, with the bow string in a cocked position and the bowstring cocking device being mounted on the crossbow.
FIG. 9 is a partial sectional view of the trigger mechanism of FIG. 8, with the release switch moved into the first position.
FIG. 10 is a partial sectional view of the trigger mechanism of FIG. 9, where force is being asserted on the bowstring cocking device.
FIG. 11 is a partial sectional view of the trigger mechanism of FIG. 10, with the safety switch moved into a firing second position and the bowstring beginning to move out of the cocked position.

The safety switch 62 is slidably received in the housing 48 and is moveable between a safety on first position (FIG. 5) and a firing second position (FIG. 10). The safety switch 62 contains a spring loaded ball 62*c* that is moveable into and out of a first recess 62*a* and a second recess 62*b*. In particular, when the safety switch 62 is (1) in the safety on first position (FIG. 5), the spring loaded ball 62*c* is positioned in the first recess 62*a*, and (2) in the firing second position (FIG. 10), the spring loaded ball 62*c* is positioned in the second recess 62*b*. The safety switch 62 also contains a knob 62*d* that can be engaged by the user to move the safety switch 62 between the first and second positions. When the safety switch 62 is in the first position (FIG. 5), the safety switch impedes counterclockwise rotation of the trigger lever 50 by engaging the trigger lever second portion 54.

A safety lever 60, pivotally mounted in the housing 48 by a pin 60*a*, operates to prevent the safety switch 62 from moving into the second position until the safety lever 60 is moved counterclockwise out of engagement with the safety switch 62. Thus, the safety lever 60 is moveable between a first locked position (FIG. 5) in which the safety lever prevents the safety switch 62 from sliding into the firing second position, and a second position (FIG. 2) in which the safety lever 60 allows the safety switch 62 to slide into the firing second position. The safety lever 60 is biased into the first locked position (FIG. 5) by a spring 74. The safety lever 60 may also be moved counterclockwise from the first locked position into the second position when the disarm mechanism 64 is moved toward the housing first slot (FIGS. 8 through 11).

The disarm mechanism 64 has a disarm mechanism first portion 64*a*, a disarm mechanism second portion 64*b*, and a disarm mechanism third portion 64*c*. The disarm mechanism 64 is slidably mounted in the housing 48 and moves between a first position (FIG. 5) and a second position (FIG. 11). The disarm mechanism 64 is biased into the first position by a spring 72. The disarm mechanism first portion 64*a* is configured to operatively engage with the trigger lever second portion 54 and to cause the trigger lever 50 to move counterclockwise around the pin 56 when the disarm mechanism 64 slides from the first position (FIG. 2) into the second position (FIG. 11). The disarm mechanism second portion 64*b* is configured to operatively engage with the release switch 66 when the release switch is in the neutral first position (FIG. 3) thereby preventing the disarm mechanism from moving out of the first position. Finally, the disarm mechanism third portion 64*c* is configured to engage the bowstring cocking rope 76*a* when the center 76*f* of the bowstring cocking rope 76*a* is positioned in the housing second slot 48*e*. In various embodiments, the disarm mechanism third portion 64*c* may be configured to extend out of an opening in the housing (e.g., the second slot 48*e* is replaced with an opening) such that the bowstring cocking rope 76*a* engages the disarm mechanism third portion outside of the housing.

The release switch 66 contains a spring loaded ball 66*c* that moves into and out of a first recess 66*a* (which corresponds to the release switch being in the first position) and a second recess 66*b* (which corresponds to the release switch being in the second position). The release switch 66 also has a release knob 66*d* that extends through the housing 48 (FIG. 1) to allow the user to move the release switch between the first and second positions. When the release switch 66 in the first position (i.e., when spring loaded ball 66*c* is in recess 66*a* (FIG. 3)) the release switch abuts the disarm mechanism second portion 64*b* and prevents the disarm mechanism from moving out of the first position. Moreover, when the release switch 66 is in the second position (i.e., when the spring loaded ball 66*c* is in recess 66*b* (FIG. 2) the release switch allows the disarm mechanism 64 to slide from the first position into the second position.

In alternate embodiments, the, the disarm mechanism 64 may be eliminated and the trigger lever second portion 54 may be configured to be engaged directly by the cocking device rope. In these embodiments, the release switch 66 is configured to block the bowstring cocking device rope 76*f* from engaging the trigger lever second portion 54 when in the first position and to allow the bowstring cocking device rope 76*f* to engage the trigger lever second portion 54 when the release switch is in the second position.

Exemplary Trigger Mechanism Operation

FIGS. 2-12 show an exemplary trigger mechanism for use in a crossbow. While trigger mechanisms exist in many guns and weapons, in this exemplary embodiment, the trigger mechanism 46 provides a release mechanism that allows a user to release a cocked crossbow without having to dry fire the weapon or engage the trigger with the user's hand.

Cocking the Crossbow

Figure 3:
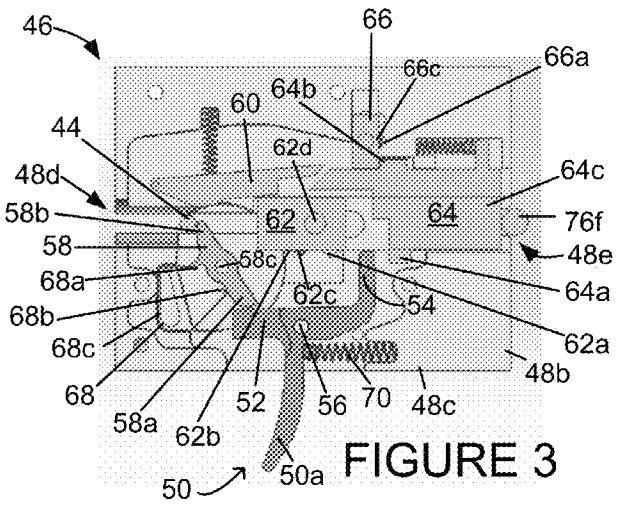
FIG. 3 is a partial sectional view of the trigger mechanism of FIG. 2, with the release switch in the first position.

FIGS. 2-5 illustrate a user cocking the crossbow 10 (FIG. 1) using the bowstring cocking device 76. Referring particularly to FIG. 2, the release switch 66 is shown in the second position 66*b*, the safety switch 62 is in the firing second position, and the bowstring catch 58 is in the release second position. Thus, prior to cocking the crossbow, the user must slide the release switch 66 from the disarm second position into the first position so that the disarm mechanism 64 is retained in the first position. The user may then attach the bowstring cocking device 76 to the bowstring 44 using hooks 76*d* and 76*e* and wrap the bowstring cocking rope 76*a* around the housing 48 so that the center 76*f* is positioned in or adjacent the housing second slot 48*e*. As the user begins to pull the bowstring cocking device handles 76*b* and 76*c* rearward (e.g. toward the housing second slot 48*e*), the bowstring 44 is drawn into the housing first slot 48*d*, as shown in FIG. 3.

FIG. 3 is a partial sectional view of the trigger mechanism of FIG. 2, with the release switch moved from the second position (FIG. 2) into the first position so that spring loaded ball 66*c* is positioned in recess 66*a*. In this position, the release switch 66 prevents the disarm mechanism 64 from sliding out of the first position as the user pulls on the bowstring cocking device handles 76*d* and 76*e*. Thus, as the user begins to pull back on the bowstring cocking device handles 76*b* and 76*c*, the hooks 76*d* and 76*e* (FIG. 1) begin to pull the bowstring 44 into the housing first slot 48*d* so that the bowstring 44 engages the catch second end 58*b* causing the catch to rotate clockwise. As the catch rotates clockwise, the catch first end 58*a* engages the trigger lever first portion 52 causing the trigger lever 50 to begin to rotate counterclockwise about pin 56 against the bias of the flat spring second end 68*b*.

Figure 5:
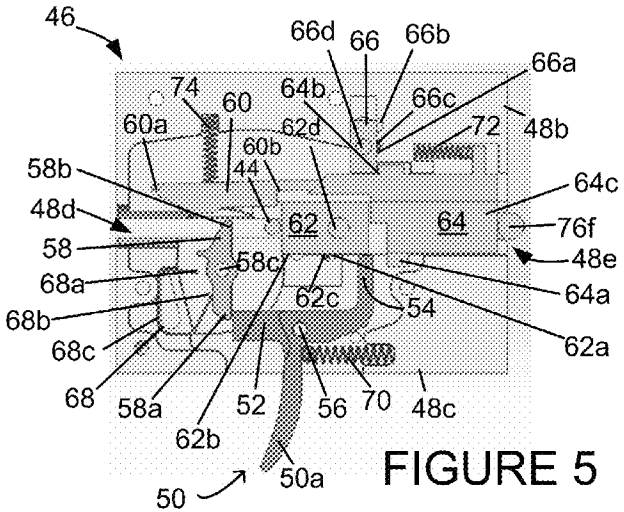
FIG. 5 is a partial sectional view of the trigger mechanism of FIG. 2, with the bow string moving into a cocked position.
Figure 4:
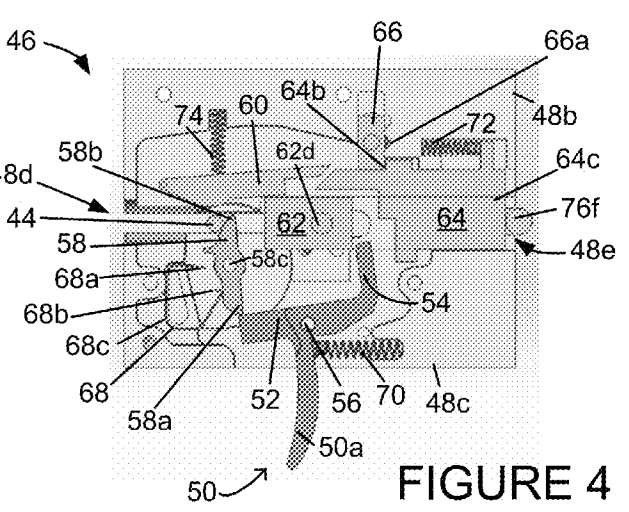
FIG. 4 is a partial sectional view of the trigger mechanism of FIG. 2, with the bow string moving into a cocked position.

Referring to FIGS. 4 and 5, as the user continues to pull the bowstring deeper into the housing first slot 48*d*, the catch 58 continues to rotate clockwise until the catch first end 58*a* moves past the trigger lever first portion 52 thereby allowing the trigger lever to rotate clockwise due to the bias of the spring 70 against the trigger lever 50. That is, once the bowstring catch first end 58*a* clears the trigger lever first portion 52, the trigger lever rotates into the position shown in FIG. 5. Moreover, the bowstring catch 58 will continue to rotate clockwise until the bowstring 44 slips past the bowstring catch second end 58*b* at which time the flat spring second end 68*b* will cause the bowstring catch 58 to rotate counterclockwise until the bowstring catch first end 58 abuts the trigger lever first portion 52, as seen in FIG. 5.

Referring to FIG. 5, as the bowstring 44 moves further into the first housing slot 48*d*, it begins to push against the safety switch 62 thereby moving the safety from the second firing position into the safety on first position where the spring loaded ball 62*c* is received in the recess 62*a*. In various embodiments, the safety switch 62 may also be manually moved into the safety on first position using the safety knob 62*d*. When the safety switch is in the safety on first position, the safety switch operatively engages the trigger lever second portion 54 thereby preventing the trigger lever from rotating in the counterclockwise direction. Furthermore, as the safety switch 62 moves from the position shown in FIG. 4 into the position shown in FIG. 5, the safety lever 60 rotates clockwise under the bias of the spring 74 until it abuts the disarm mechanism 64 (FIG. 5). When the safety lever 60 moves into this position, a recess 60*b* formed in the safety lever 60 abuts an upper corner of the safety switch 62 thereby preventing the safety switch from moving from the safety on first position into the firing position.

Figure 6:
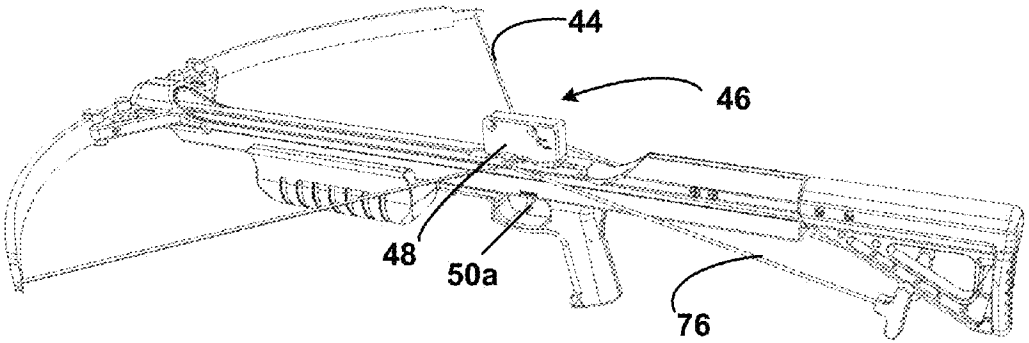
FIG. 6 is a perspective view of the crossbow of FIG. 1 with the bow string in a cocked position and the rope cocking device coupled to the bowstring and trigger mechanism.
Figure 7:
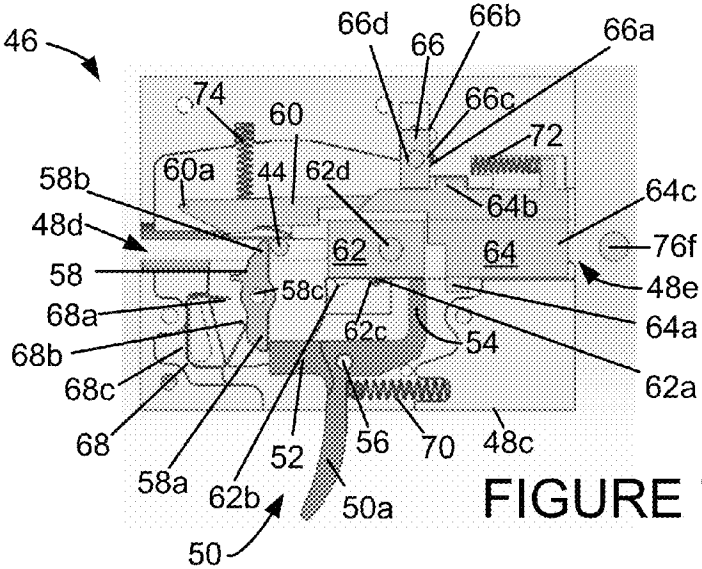
FIG. 7 is a partial sectional view of the trigger mechanism of FIG. 2, with the bow string in a cocked position and the bowstring cocking device being removed from the crossbow.

Referring to FIGS. 6 and 7, once the safety switch is moved into the safety on first position (FIG. 5) the user can then release tension on the bowstring cocking device 76 so that the bowstring is retained in the cocked position by the bowstring catch 58. At this point, the user can disconnect the bowstring cocking mechanism thereby removing the center 76*f* of the bow string cocking rope 76*a* from the housing second slot 48*e*. Referring particularly to FIG. 7, the bowstring 44 is in the cocked position and the bowstring coking device 76 (FIG. 6) is being removed from the crossbow.

In particular, the bowstring catch second end 58*b* retains the bowstring 44 in the cocked position since the trigger lever first portion 52 prevents the bowstring catch from rotating counterclockwise. The safety switch 62 is in the safety on first position 62*a* thereby preventing the trigger lever from rotating counterclockwise around pin 56. As a result, the crossbow 10 with the bowstring 44 in the cocked position (FIG. 6) is now ready to either be fired or uncocked without dry firing or without the user having to manually engage the trigger 50*a* release the bowstring 44. If the user wishes to fire the crossbow 10, the user would rotate the trigger lever 50 counterclockwise around pin 60*a* a sufficient distance to allow the safety switch to be moved from the safety on first position into the firing position. Otherwise, the crossbow string 44 may be released as described below.

Releasing the Crossbow

Referring to FIGS. 8 and 9, if the user wishes to release the bowstring 44 without firing or dry firing the crossbow 10, the user may do so using the release mechanism of the trigger mechanism 46. In particular, the user would first reattach the bowstring cocking device 76 by placing the center 76*f* of the bowstring cocking device rope 76*a* into the housing second slot 48*e* and then attach each hook 76*d* and 76*e* to the bowstring 44. Once the bowstring cocking device is properly attached, and referring to FIG. 9, the user then moves the release switch 66 from the first position into the second position so that the spring loaded ball 66*c* moves from the first recess 66*a* into the second recess 66*b*. The safety switch 62 is in the safety on first position, which prevents counterclockwise rotation of the trigger lever 50. As a result, the user may begin to exert rearward force on the bowstring cocking device handles 76*d* and 76*e* so as to pull the bowstring 44 deeper in the housing first slot 48*d*.

Referring to FIG. 10, as the user begins to exert rearward force on the bowstring cocking device handles 76*d* and 76*e*, the center portion 76*f* begins to exert forward force on the disarm mechanism 64 since at least a portion of the disarm mechanism third portion 64*c* is within the housing second slot 48*e*. As a result, the disarm mechanism 64 begins to slide forward from its first position toward its second position. Moreover, as the release mechanism moves toward its second position, it begins to move the safety switch from its safety on first position toward the firing second position, as shown in FIG. 10.

Referring to FIG. 11, as the bowstring 44 is pulled further rearward into the housing second slot 48*e*, the bowstring cocking device rope 76*a* moves the disarm mechanism 64 further forward thereby pushing the safety switch into the firing position so that the spring loaded ball 62*c* is positioned in the second recess 62*b*. Additionally, as the disarm mechanism moves forward, the disarm mechanism first portion 64*a* engages the trigger lever second portion 54 causing the trigger lever 50 to rotate counterclockwise. Said another way, as the trigger lever 50 rotates counterclockwise against the bias of spring 70, flat spring second end 68*b* biases the bowstring catch first end 58*a* thereby causing the bowstring catch 58 to rotate counterclockwise until the bowstring catch first end 58*a* clears the trigger lever first portion 52.

Referring to FIG. 12, the bowstring catch 58 continues to rotate counterclockwise until the flat spring first end 68*a* engages the bowstring catch second end 58*b*. Once the bowstring 44 is allowed to move further out of the housing first slot 48*d*, the bowstring 44 engages with the bowstring catch second end 58*b* thereby causing the bowstring catch 58 to rotate counterclockwise against the bias of the flat spring first end 68*a*. Once the bowstring 44 passes the bowstring catch second end 58*b*, the bowstring catch rotates counterclockwise until the bowstring catch first end 58*a* abuts the top of the trigger first portion 52, as shown in FIG. 2. The user may then continue to slowly release the bowstring 44 until it reaches the un-cocked position as shown in FIG. 1. At this point, the user may remove the bowstring cocking device 76 from the crossbow.

CONCLUSION

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations as confirmed by the various embodiments disclosed herein. Therefore, it is to be understood that the invention is not to be limited to the specific embodiments disclosed and that the modifications and other embodiments are intended to be included within the scope of the appended exemplary concepts. Although specific terms are employed herein, they are used in a generic and descriptive sense only and not for the purposes of limitation. The description of the above exemplary embodiments should teach one of skill in the art that many more alternatives exist for releasing a crossbow string without dry firing or requiring the user to engage the trigger.

I claim:

1. A trigger mechanism for use in a crossbow having a bowstring, the trigger mechanism comprising:

a. a housing having i. a first slot formed in a first side of the housing where first slot is configured to receive the bowstring of the crossbow when the crossbow is cocked; and ii. a second opening formed in a second side of the housing opposite from the first side;

b. a trigger lever pivotally mounted in the housing, the trigger lever comprising a trigger, the trigger level moveable between a first trigger lever position and a second trigger lever position;

c. a catch that is pivotally mounted in the housing, the catch having:

i. a catch first end configured to operatively engage with the trigger lever; and ii. a catch second end configured to retain the bowstring in a cocked position, wherein the catch is moveable between a cocked first position and a release second position;

d. a disarm mechanism in operative engagement with the trigger lever and partially positioned in the second opening, the disarm mechanism moveable between a first position and a second position, wherein i. the disarm mechanism is configured to be retained in a fixed the first position, and ii. a s the disarm mechanism moves from the first position to the second position, the disarm mechanism contacts the trigger lever and pivots the trigger lever from the first trigger lever position to the second trigger lever position, thereby allowing the catch to move from the catch first position into the catch second position, e. further comprising a bowstring cocking device comprising:

i. an elongated rope having a first end and a second end;

ii. one of a first handle coupled to the rope first end and a second handle coupled to the rope second end and a crank coupled to the first and second ends of the elongated rope;

iii. a first hook and a second hook, wherein the first and second hooks are positioned on the elongated rope intermediate the first and second ends; and f. wherein when the bowstring cocking device is attached to the bowstring and positioned adjacent to the housing second slot and tension is exerted on the first and second handles, the disarm mechanism moves toward the housing first slot causing the trigger lever to move out of engagement with the catch first end so that the catch can move from the catch first position into the catch second position as the bowstring is slowly released using the bowstring cocking device.

2. The trigger mechanism of claim 1, wherein the disarm mechanism comprises a disarm block that is slidably mounted in the housing, wherein the disarm block has a disarm block first end configured to operatively engage the trigger lever when the disarm block moves from the first position toward the second position.

3. The trigger mechanism of claim 2, wherein the trigger lever has a trigger lever first portion configured to operatively engage the catch first end and a trigger lever second portion configured to operatively engage with the disarm block first end.

4. The trigger mechanism of claim 1, further comprising a safety switch that is moveable between:

a. a safety switch first position in which the safety switch impedes movement of the trigger lever; and b. a safety switch second position in which the safety switch allows the trigger lever to move out of engagement with the catch first end when the trigger is engaged by the user.

5. The trigger mechanism of claim 1, further comprising a release switch that is moveable between a release switch first position and a release switch second position, wherein when the release switch is in the second position and the bowstring is pulled further into the housing first slot using a bowstring cocking device, the disarm mechanism is configured to move away from the housing second slot toward the housing first slot thereby causing the trigger lever to move out of engagement with the catch first end allowing the catch to move from the catch first position into the catch second position.

6. The trigger mechanism of claim 1, further comprising a crossbow having:

a. an elongated body;

b. a first limb coupled to a first end of the elongated body;

c. a second limb coupled to the elongated body first end; and d. a bowstring having a bowstring first end operatively coupled to the first limb and a bowstring second end operatively coupled to the second limb, wherein the trigger mechanism is configured to couple to the elongated body so that the housing first slot aligns with a path on which the bowstring travels when the bowstring is moved into the cocked position.

7. The trigger mechanism of claim 6, wherein when the disarm mechanism moves from the fixed first position into the release second position, the disarm mechanism slides linearly towards the housing first slot.

8. The trigger mechanism of claim 1, wherein the second opening is a slot and the disarm block third portion is positioned at least partially in the second slot such that the disarm block third portion may be engaged by a portion of a bowstring cocking device rope when the bowstring cocking device is used to draw the bowstring into a cocked position.

9. The trigger mechanism of claim 1, wherein the third portion of the disarm block extends through the second opening outside of the housing and is configured to be engaged by a rope of a bowstring cocking device when the bowstring cocking device is used to draw the bowstring into a cocked position.

10. A trigger mechanism for use in a crossbow having a bowstring, the trigger mechanism comprising:

a. a housing having i. a first slot formed through one side of the housing, wherein the slot is configured to receive the bowstring of the crossbow when the crossbow is cocked; and ii. a second opening formed in an opposite side of the housing, wherein the second opening is configured to receive a portion of a disarm mechanism therein;

b. a trigger lever pivotally mounted in the housing, the trigger lever comprising a trigger;

c. a catch that is pivotally mounted in the housing, the catch having:

i. a catch first end configured to operatively engage the trigger lever; and ii. a catch second end configured to retain the bowstring in a cocked position, wherein the catch is moveable between a cocked first position where the trigger lever engages the catch first end and a release second position where the trigger lever does not impede rotation of the catch;

d. the disarm mechanism moveably mounted in the housing so that at least a portion of the disarm mechanism partially intersects the housing second slot, the disarm mechanism moveable between a first neutral position and a second release position, wherein i. when the disarm mechanism is retained in a fixed the first neutral position, the disarm mechanism is out of engagement with the trigger lever, and ii. as the disarm mechanism moves from the first neutral position into a to the second release position, the disarm mechanism contacts the trigger lever and pivots the trigger lever, causing the trigger lever to move out of engagement with the catch first end thereby allowing the catch to move from the catch first position into the catch second position.

e. further comprising a bowstring cocking device comprising:

i. an elongated rope having a first end and a second end;

ii. one of a first handle coupled to the rope first end and a second handle coupled to the rope second end and a crank coupled to the first and second ends of the elongated rope;

iii. a first hook and a second hook, wherein the first and second hooks are positioned on the elongated rope intermediate the first and second ends; and f. wherein when the bowstring cocking device is attached to the bowstring and positioned adjacent to the housing second slot and tension is exerted on the first and second handles, the disarm mechanism moves toward the housing first slot causing the trigger lever to move out of engagement with the catch first end so that the catch can move from the catch first position into the catch second position as the bowstring is slowly released using the bowstring cocking device.

11. The trigger mechanism of claim 10, wherein a. the disarm mechanism comprises a disarm block that linearly slides in the housing;

b. the disarm block slides toward the housing second slot when the disarm block moves into the first neutral position from the second release position; and c. the disarm block slides toward the housing first slot when the disarm block moves into the second release position from the first neutral position.

12. The trigger mechanism of claim 11, wherein the trigger lever has a trigger lever first portion configured to engage with the catch first end and a trigger lever second portion configured to engage with the disarm block.

13. The trigger mechanism of claim 11, wherein when the disarm block is moved from the first neutral position into the second release position, the disarm block causes the trigger lever to rotate out of engagement with the catch first end thereby allowing the catch to rotate.

14. The trigger mechanism of claim 11, wherein the housing is configured to couple to a crossbow.

15. The trigger mechanism of claim 11, further comprising a safety switch that is moveable between a safety on first position in which the safety switch impedes movement of the trigger and a firing second position in which the safety switch allows movement of the trigger lever.

16. The trigger mechanism of claim 15, wherein when the disarm mechanism moves from the first neutral position into the second release position, the disarm mechanism moves the safety switch from the safety on first position into the firing second position.

17. A crossbow comprising:

a. an elongated body having an elongated body first end and an elongated body second end;

b. a first limb coupled to the elongated body first end;

c. a second limb coupled to the elongated body first end;

d. a bowstring having a bowstring first end operatively coupled to the first limb and a bowstring second end operatively coupled to the second limb;

e. a catch moveably mounted to the elongated body intermediate the body first and second ends, the catch having a catch first end and a catch second end configured to retain the bowstring in a cocked position;

f. a trigger lever moveably mounted to the elongated body intermediate the elongated body first and second ends, the trigger lever comprising a trigger, a trigger lever first portion configured to engage with the catch first end and a trigger lever third portion; and g. a disarm mechanism moveably mounted in the elongated body, wherein the disarm mechanism is configured to move between a first position in which the disarm mechanism prevents a bowstring cocking device from causing the trigger lever to rotate and a disarm second position in which the bowstring cocking device is allowed to rotate the trigger lever, wherein i. when the disarm mechanism is in the first position, the bowstring is in the cocked position, and the trigger is engaged by a user, the trigger lever is configured to allow the catch to move from a catch first position in which the catch second end retains the bowstring in the cocked position into a catch second position in which the catch second end releases the bowstring, and ii. when the disarm mechanism moves into the disarm second position the disarm mechanism contacts the trigger lever and moves the trigger lever out of engagement with the catch first end so that the catch can move from the catch first position into the catch second position, h. further comprising a bowstring cocking device comprising:

i. an elongated rope having a first end and a second end;

ii. one of a first handle coupled to the rope first end and a second handle coupled to the rope second end and a crank coupled to the first and second ends of the elongated rope;

iii. a first hook and a second hook, wherein the first and second hooks are positioned on the elongated rope intermediate the first and second ends; and i. wherein when the bowstring cocking device is attached to the bowstring and positioned adjacent to the housing second slot and tension is exerted on the first and second handles, the disarm mechanism moves toward the housing first slot causing the trigger lever to move out of engagement with the catch first end so that the catch can move from the catch first position into the catch second position as the bowstring is slowly released using the bowstring cocking device.

18. The crossbow of claim 17, wherein the disarm mechanism further comprises a disarm block that is slidably mounted in the elongated body, the disarm block comprising a. a first end in operative engagement with the trigger lever second portion; and b. a second end configured to be operatively engaged by the bowstring cocking device, wherein the disarm block is configured to move from the disarm mechanism first position into the disarm mechanism second position when force is applied to the bowstring by the bowstring cocking device.

19. The crossbow of claim 18, further comprising a housing that is coupled to the elongated body intermediate the elongated body first and second ends, wherein the trigger lever is rotatably mounted in the housing, the catch is rotatably mounted in the housing, and the disarm mechanism is slidably mounted in the housing, wherein the housing further comprises:

a. a housing first slot formed in a first side of the housing proximate the elongated body first end, wherein the housing first slot is configured to receive the bowstring as the bowstring is moved into the cocked position; and b. a housing second opening formed in a second side of the housing proximate the elongated body second end, wherein at least a portion of the disarm mechanism is positioned in the housing second opening.

20. The crossbow of claim 19, wherein the second opening is a slot and the second portion of the disarm block intersects the second slot.

* * * * *